US005477653A

United States Patent [19]

Altmayer

[11] Patent Number: 5,477,653

[45] Date of Patent: Dec. 26, 1995

[54] DECORATIVE PANEL

[75] Inventor: Andreas Altmayer, Mils, Austria

[73] Assignee: D. Swarovski & Co., Wattens, Austria

[21] Appl. No.: 309,092

[22] Filed: Sep. 20, 1994

[30] Foreign Application Priority Data

Sep. 23, 1993 [DE] Germany ..... 43 32 458.4

[51] Int. Cl.[6] ..... B44F 7/00

[52] U.S. Cl. ..... 52/311.1; 362/305; 362/330; 428/13

[58] Field of Search ..... 52/311.1, 786, 52/788; 472/61, 63, 58; 359/850, 857, 871; 362/297, 304, 305, 333, 328, 330, 806; 428/13, 84

[56] References Cited

U.S. PATENT DOCUMENTS 5,137,766 8/1992 Altmayer ..... 428/13

5,139,828 8/1992 Altmayer ..... 428/13

*Primary Examiner*—Carl D. Friedman
*Assistant Examiner*—Creighton Smith
*Attorney, Agent, or Firm*—Fay, Sharpe, Beall, Fagan, Minnich & McKee

[57] ABSTRACT

A decorative panel comprising a first transparent plate on which a multiplicity of faceted glass stones is fixed in an ornamental arrangement, and a second plate with a reflective layer which is held at a distance from the first plate and from the glass stones by a frame, whereby the second plate has an area not provided with a reflective layer below which a decorative body is disposed on the inner side of the plate, the side surface of said body being provided with a reflective layer so that light fed from a light source into the decorative panel is reflected on this side surface.

10 Claims, 1 Drawing Sheet

DECORATIVE PANEL

Figure 1:
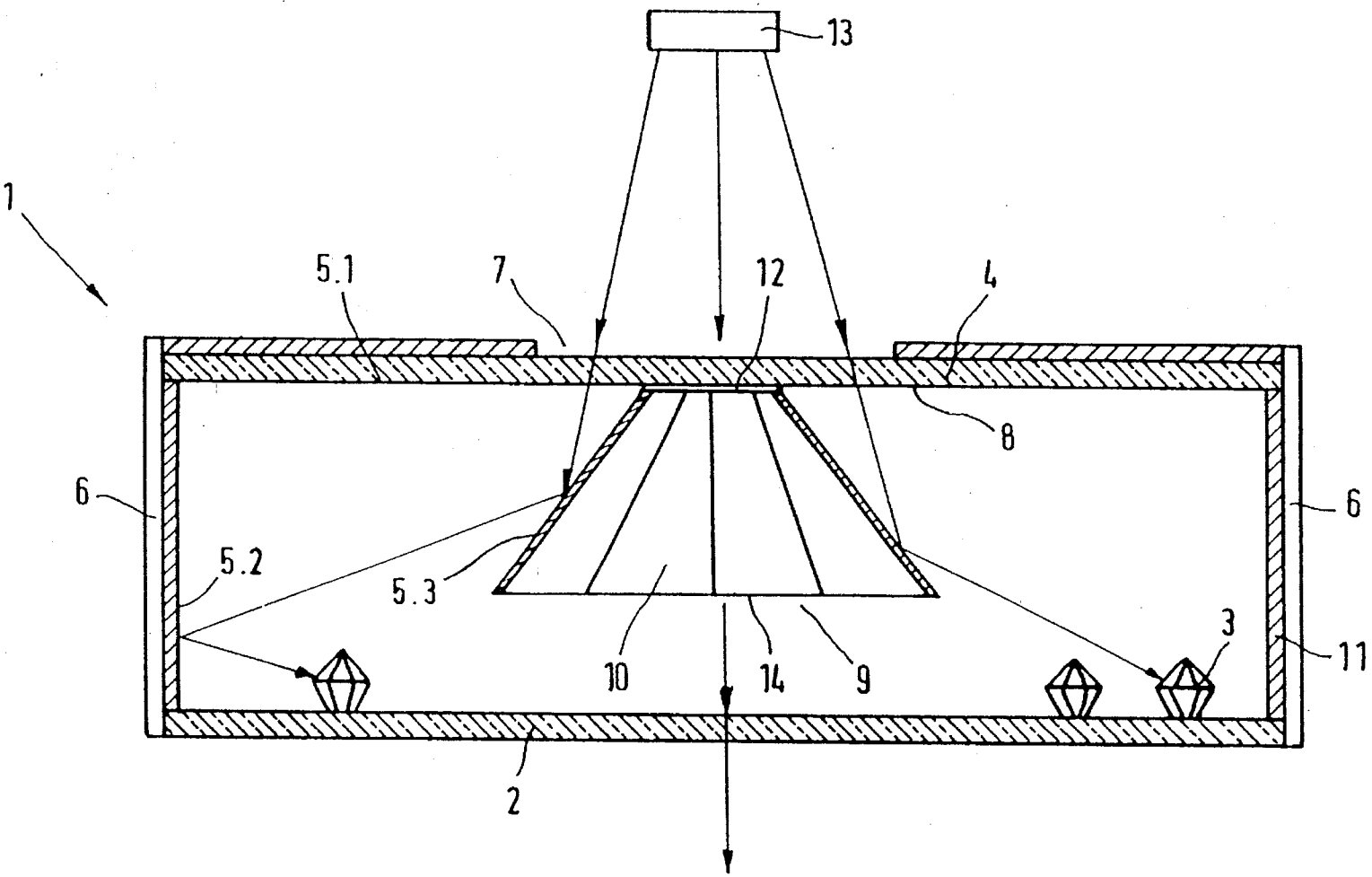

The present invention relates to a decorative panel including a transparent plate on which a multiplicity of faceted small glass stones are fixed in an ornamental arrangement.

Different kinds of decorative panels are known, including ones with faceted glass stones provided on a transparent plate in an ornamental arrangement, as described in CH-C 65 40 65. The prior art further includes a decorative panel in which the glittering effect of the glass stones is intensified by combining the plate bearing these glass stones with a reflecting plate, the transparent plate with glass stones and the reflecting plate being held spaced apart by a frame. Such a decorative panel is described in DE-C 40 16 700.

Decorative panels of the abovementioned type are used for example for the interior design of ceiling and wall surfaces. However there is still a great need to provide new decorative panels which are characterized by special optical and esthetic effects and which can also obtain advantages in terms of lighting engineering.

The invention is therefore based on the problem of providing new decorative panels having special optical, esthetic and lighting effects.

The object of the invention is a decorative panel comprising a first transparent plate on which a multiplicity of faceted glass stones are fixed in an ornamental arrangement, and a second plate with a reflective layer which is held at a distance from the first plate and from the glass stones by a frame, characterized in that the second plate has an area not provided with a reflective layer below which a decorative body is disposed on the inner side of the plate, the side surface of said body being provided with a reflective layer so that light fed from a light source into the decorative panel is reflected on this side surface.

The inventive decorative panel takes equal account of optical and esthetic effects and offers the possibility of decorative illumination.

As with known decorative panels, the impression is aroused that glass stones are fixed both on the transparent plate and on the plate provided with a reflective layer. The three-dimensional effect is intensified and the glittering effect caused by the faceted glass stones is multiplied by the reflective plate. These effects can be influenced in a favorable way by mounting a decorative body whose surface is provided with a reflective layer. This decorative body is disposed on the plate provided with the reflective layer, the reflective layer being omitted in the area where the body is disposed. Through this area light emitted by a light source can pass into the decorative panel, light rays being reflected when they hit the side surface provided with a reflective layer. Light rays deflected onto the glass stones enhance their glittering effect.

It is advantageous to design the decorative body so that its side surface has areas which are at an angle of 30 to 60° C, preferably an angle of about 45° , to perpendicular incident light. Such angles of inclination ensure that light rays hitting the side surface are reflected at an angle, hit a reflective inner wall of the frame and are deflected from there onto the glass stones. The selection of the angle of inclination will depend on the size of the light entrance source and on the distance between the light source and the decorative panel.

In a particularly advantageous embodiment of the invention the inner wall of the frame is likewise provided with a reflective layer. Light rays which are deflected by the decorative body and hit the frame are reflected again and used for directly illuminating the glass stones or the total decorative panel.

The transparent plate and also the second plate which bears the reflective layer are preferably made of glass, in particular float glass.

For optical or physical reasons it is further advantageous to shape the decorative body as a truncated cone, connecting it with the inner side of the second plate with its smaller base. Optimal reflection or deflection of the incident light rays takes place here.

The decorative body can have a smooth surface or preferably be faceted for optical/esthetic reasons. A suitable material is in particular glass. The size of the decorative body can be 5 to 10 cm in diameter and 2 to 6 cm in height. The size will depend in particular on the size of the total decorative panel. This is preferably 40×40 cm.

The reflective layer is preferably a mirror layer, to which a protective layer is optionally applied.

With respect to the optical/esthetic effect of the decorative panel, the decorative body is provided with a reflective layer on its total surface so that all incident light is first deflected onto the inner surface of the frame and then made to illuminate the glass stones.

If the decorative panels are also to be used directly for lighting the room, it can also be advantageous to provide the decorative body with a reflective layer in such a way that incident light partly passes through it. If the decorative body is shaped as a truncated cone the two bases would then not be provided with a reflective layer.

In the following the invention will be explained in more detail with reference to a drawing.

This drawing shows a preferred embodiment of inventive decorative panel 1 which is spaced from light source 13. Decorative panel 1 is constructed from transparent plate 2, which is preferably made of glass, second transparent plate 4 spaced therefrom and frame 6. Frame 6 holds plates 2 and 4 spaced apart and connects them at the same time. Faceted glass stones are disposed on transparent plate 2.

These faceted glass stones are preferably cut glass stones of lead crystal. The size can vary within wide limits, for example between 0.3 and 10 mm. As for the shape, chatons are particularly suitable, but roses can also be used. The chatons are glued to the panel on transparent plate 2 which will face the viewer. The glass stones are preferably colorless but can also—possibly only partly-be made of colored glass or vaporized with metal layers.

Transparent plate 4 bears reflective layer 5.1, preferably a mirror layer, which is omitted in area 7 on plate 4. This free area is preferably provided on the plate in the center and in a circular shape. Free area 7 is preferably designed with a contour that corresponds to the outer contour of decorative body 9 since transparent decorative body 9 is disposed below area 7.

In the embodiment shown this decorative body is shaped as a truncated cone and its surface 10 has facets. Surface 10 is provided partly, i.e. only on the lateral surfaces, with reflective layer 5.2, preferably a mirror layer. Bases 12 and 14 are not metal-coated so that light rays can readily pass through. The shape of the decorative body is widely variable. For example it is also possible to use a hemispherical shape having on the side opposite the cut surface a further cut surface, i.e. a plane surface for entrance of light. The curved surface can then again be smooth or faceted. In the embodiment shown the angle of inclination of the lateral surface of the truncated cone relative to perpendicular incident light is about 45° C.

In the embodiment shown, inner wall 11 of the frame is also provided with reflective layer 5.2, preferably a mirror layer. Light source 13 emits light rays that pass into the decorative panel via free area 7 of reflective layer 5.1. Since bases 12 and 14 of decorative body 9 are not provided with a reflective layer all light rays hitting the area of base 12 of decorative body 9 pass through.

All light rays passing into the decorative panel through transparent plate 4 beside base 12 hit reflective layer 5.3 of surface 10 of decorative body 9, and are reflected from there either directly onto the glass stones or first onto reflective layer 5.2 on inner wall 11 of frame 6. From there they are reflected again and deflected onto glass stones 3. The sum of the light rays received by glass stones 3 is thus increased so that their glittering effect is intensified. Inventive decorative panel 1 simultaneously permits illumination of the room.

Both glass stones 3 and decorative body 9 are fastened to plates 2, 4 with a transparent adhesive, in particular an adhesive made of UV hardening acrylic resin. Decorative body 9 can optionally also be connected with plate 4 rotatably.

The inventive decorative panel can be used either singly or in conjunction with several panels for decorative design of ceilings and walls. It is in particular advantageous when used with several decorative panels disposed side by side since it is easy to mount and the arrangement does not restrict the light supply.

I claim:

1. A decorative panel (1) comprising a first transparent plate (2) on which a multiplicity of faceted glass stones (3) are fixed in an ornamental arrangement, and a second plate (4) with a reflective layer (5.1) which is held at a distance from the first plate (2) and from the glass stones (3) by a frame (6), characterized in that the second plate (4) has an area (7) not provided with a reflective layer (5.1) below which a decorative body (9) is disposed on the inner side (8) of the plate (4), the side surface (10) of said body being provided with a reflective layer (5.3) so that light fed from a light source (13) into the decorative panel (1) is reflected on this side surface (10).

2. The decorative panel of claim 1, characterized in that the side surface (10) has areas that are at an angle between 30 to 60° relative to perpendicular incident light.

3. The decorative panel of claim 1, characterized in that the frame (6) is likewise provided on its inner wall (11) with a reflective layer (5.2).

4. The decorative panel of claim 1, characterized in that the transparent plate (2) and the second plate (4) are made of glass.

5. The decorative panel of claim 1, characterized in that the decorative body (9) is shaped as a truncated cone and connected with the plate (4) with its smaller base (12).

6. The decorative panel of claim 1, characterized in that the surface (10) of the decorative body (9) is faceted.

7. The decorative panel of claim 1, characterized in that the decorative body (9) is transparent.

8. The decorative panel of claim 1, characterized in that the decorative body (9) is made of glass.

9. The decorative panel of claim 1, characterized in that the reflective layers (5.1, 5.2, 5.3 ) are mirror layers.

10. The decorative panel of any of the above claim 1, characterized in that the decorative body (9) is provided with a reflective layer in such a way that fed-in light partly passes through it.

* * * * *